US005423458A

United States Patent [19]

Tourigny

[11] Patent Number: 5,423,458

[45] Date of Patent: Jun. 13, 1995

[54] ELECTROSTATIC-SAFE AEROSOL DISPENSER

[75] Inventor: Jay S. Tourigny, Collinsville, Conn.

[73] Assignee: Micro Care Corporation, Bristol, Conn.

[21] Appl. No.: 234,667

[22] Filed: Apr. 28, 1994

[51] Int. Cl.[6] ..... B67D 1/07

[52] U.S. Cl. ..... 222/192; 222/566; 222/575; 361/212; 361/215

[58] Field of Search ..... 222/192, 526, 566, 575; 239/690, 691; 361/212, 215, 220

[56] References Cited

U.S. PATENT DOCUMENTS

| | | | |
|---|---|---|---|
| 2,158,965 | 5/1939 | Heigis . | |
| 2,569,489 | 10/1951 | Newman | 361/215 X |
| 2,968,441 | 1/1961 | Holcomb . | |
| 3,084,700 | 4/1963 | Fischer et al. | 361/212 X |
| 3,121,187 | 2/1964 | Hartsock et al. . | |
| 3,982,157 | 9/1976 | Azuma et al. . | |
| 4,350,299 | 9/1982 | Stephenson et al. . | |
| 4,401,271 | 8/1983 | Hansen . | |
| 4,401,272 | 8/1983 | Merton et al. . | |
| 4,682,713 | 7/1987 | Clapp . | |
| 4,694,375 | 9/1987 | Devins et al. . | |
| 4,819,837 | 4/1989 | Goforth . | |
| 4,895,280 | 1/1990 | Tourigny . | |
| 5,058,783 | 10/1991 | Antonelli . | |
| 5,086,756 | 2/1992 | Powell . | |
| 5,174,478 | 12/1992 | Reyman . | |

*Primary Examiner*—Gregory L. Huson

*Attorney, Agent, or Firm*—Victor E. Libert; Frederick A. Spaeth

[57] ABSTRACT

A nozzle (10) which is mountable on conventional aerosol dispensing valves comprises an electrically conductive extension tube (18) situated to receive discharge from the outlet of an aerosol product dispenser. The nozzle also includes an actuation member (28) which is electrically connected to the extension tube (18) and which is dimensioned and configured so that the user can dispense aerosol product by depressing the actuation member (28). Optionally, the extension tube (18) comprises a detachable discharge region (24) to allow the use of a variety of differently configured tube outlets.

14 Claims, 2 Drawing Sheets

10
12
14
16
18
20
22
23
24
24'
24"
26
26'
26"
28
29
30
31
32
34
35
36
38
40
42

18'
10"
28"
50
48
36'
36a 22a
50

10'
20'
36
28
14

20'
44
22'

20"
22"
46

ELECTROSTATIC-SAFE AEROSOL DISPENSER

BACKGROUND OF THE INVENTION

1. Field of the Invention

This invention relates to aerosol spray dispersal and more specifically to the dispersal of static electricity developed on a spray nozzle during discharge of aerosol spray-type products.

2. Related Art

Many industrial processes give rise to electrostatic charges that develop on work stations and workpiece materials. Electrostatic charges are typically generated by friction between moving parts or materials, and are discharged when a charged object or material comes into contact with another object or material having a different charge. Static electricity can also be discharged through the human body should a worker make simultaneous contact between two objects of differing charges. Electrostatic charges of ordinary scale, e.g., those developed by walking across a carpeted room, do not normally pose a safety problem to humans or to a wide variety of industrial tools or products. However, static electricity is considered to be a significant hazard in relation to the production of modern electronic components, especially those incorporating integrated circuitry. Such circuitry is often very delicate and can be irretrievably damaged by the current created when otherwise innocuous quantities of static electricity are discharged through a workpiece comprising the circuit. The threat becomes more acute as integrated circuitry becomes increasingly miniaturized.

A variety of aerosol products are useful in the assembly of electronic components, e.g., soldering flux remover, circuitry coolant, cleaners, protective coatings, lubricants, release agents, and dusters. However, as these products flow through the aerosol dispenser valve upon use, they develop electrostatic charges to a degree that poses a hazard to the components on which they are used. One product that is available to alleviate this hazard comprises an aerosol dispensing spout that includes a grounding wire that attaches to the spout, to the workpiece and/or to a ground to which the user is also grounded. The device is described as insulating the user from the static electricity. The device is sold under the trade designation AEROGROUND TM and is sold by the Tech Spray Company of Amarillo, Texas. The AEROGROUND TM device is believed to be described in U.S. Pat. No. 4,819,837, dated Apr. 11, 1989, to Goforth.

A known expedient for preventing the discharge, onto a workpiece, of static electricity carried by a worker is to ground the worker by attaching a ground wire to his or her body. One such device is a wrist strap such as may be obtained from Charleswater Products, of West Newton, Mass.

SUMMARY OF THE INVENTION

The present invention relates to a user-grounded spray nozzle for an aerosol-type spray can having a dispersal valve having an outlet. The nozzle comprises an electrically conductive extension tube having (a) an inlet region comprising a tube inlet for receiving the gaseous or aerosol discharge from the outlet of the dispersal valve, or of a trigger device on the dispersal valve, the trigger device having an actuation surface and an outlet, and (b) a discharge region comprising a tube outlet for expelling the contents of the can. The nozzle also comprises an electrically conductive actuation member comprising an essentially electrically conductive tube engagement portion and a trigger portion. The tube engagement portion secures the actuation member to the extension tube and thereby provides electrical conductivity between the extension tube and the trigger portion. The trigger portion is dimensioned and configured so that by pressing the trigger portion the user can actuate the valve and release the aerosol product through the extension tube. The actuation member thus provides a static electricity discharge connection between the extension tube and the trigger portion of the actuation member so that static electricity can be shunted from the extension tube to a user's body when the user depresses the actuation member.

According to one aspect of the invention, the tube inlet may be dimensioned and configured to engage the outlet of a dispersal fixture and the trigger portion of the actuation member may be dimensioned and configured to engage the actuation surface of the dispersal fixture when the tube inlet engages the outlet of the dispersal fixture.

According to another aspect of the invention, the tube engagement portion may comprise a spring clamp that firmly but slidably engages the extension tube. The spring clamp may comprise a first anchor portion, a bridge portion adjacent to the first anchor portion and a second anchor portion adjacent to the bridge portion. The first anchor portion may comprise a first tube aperture dimensioned and configured to receive the extension tube therein, and the second anchor portion may comprise a second tube aperture dimensioned and configured to receive the extension tube therein. The extension tube is then disposed within both the first and second tube apertures.

According to another aspect of the invention, the inlet region of the extension tube may be swaged to provide a friction fit in the dispenser valve to secure the tube inlet therein.

According to various other aspects of the invention, the trigger portion may be dimensioned and configured to secure the nozzle to the dispenser valve; there may be at least one fence member mounted on the extension tube to limit the sliding travel of the actuation member on the extension tube; and the extension tube may comprise separable parts, including a first part comprising the inlet region and a second part comprising the discharge region.

In an alternative embodiment, the nozzle described above may be combined with an aerosol spray can to provide an aerosol dispenser comprising a closed cannister for storing a pressurized fluid product. The cannister has an actuator valve for opening the cannister to allow the fluid product to be expelled from the cannister, and the valve is equipped with a nozzle as described above.

In any of the foregoing embodiments the discharge region of the extension tube may have a tapered configuration. Alternatively, the discharge region of the extension tube has a flared configuration, and optionally, the tube outlet may have a sawtooth configuration.

As used herein and in the claims the adverb "manually", as used in the phrase "the user manually depresses the actuation member," indicates direct physical contact between the user's body and the actuation member.

DETAILED DESCRIPTION OF THE INVENTION AND PREFERRED EMBODIMENTS THEREOF

The present invention relates to a spray nozzle that can be attached to conventional aerosol can dispenser packages to shunt away from a workpiece static electricity developed by the flow of the contents of the container through the valve and nozzle. A conventional aerosol spray can is usually equipped with a dispersal valve, most typically a stem valve, through which the pressurized contents of the can may pass in a controlled manner. Typically, the aerosol can dispersal valve is covered with a dispersal fixture that has an actuation surface, e.g., the dispersal fixture on a stem valve is often a spray button having a finger-engaging surface which the user depresses to actuate or open the stem valve. The dispersal fixture has a flow conduit running therethrough, the conduit having an inlet connected to the dispersal valve and an outlet for dispensing the aerosol spray. The present invention comprises a nozzle adapted for use with such conventional dispersal valves or the dispersal fixtures thereon.

A nozzle according to one embodiment of the present invention comprises an extension tube having an inlet that is disposed in fluid-flow communication with the outlet of a dispersal fixture on a dispersal valve, so that the contents of the can flows through the extension tube before being dispersed. The extension tube is made from an electrically conductive material and has a discharge region which terminates at a tube outlet from which the contents are discharged. Optionally, the tube comprises separable parts or sections, e.g., a discharge section that is threaded and which can be screwed into the inlet section. Thus, the discharge section is detachable from the main portion of the tube, so that substitute discharge sections having outlets of varying configurations may be used.

The nozzle also comprises an actuation member which is also made from an electrically conductive material. The actuation member comprises a tube engagement portion which secures the actuation member to the extension tube and provides an electrical connection between the extension tube and the actuation member. The actuation member has a trigger portion that the user manually depresses while opening the dispenser valve. When the aerosol can comprises a dispersal fixture such as a spray button, the trigger portion of the actuation member is preferably dimensioned and configured to engage the actuation surface of the dispersal fixture, so that by pressing the trigger portion of the actuation member, the user actuates the dispersal valve. In such embodiments, the inlet of the extension tube is dimensioned and configured to enngage the outlet of the dispersal fixture.

Figures 3A, 3B, 3C, 4A, 4B:
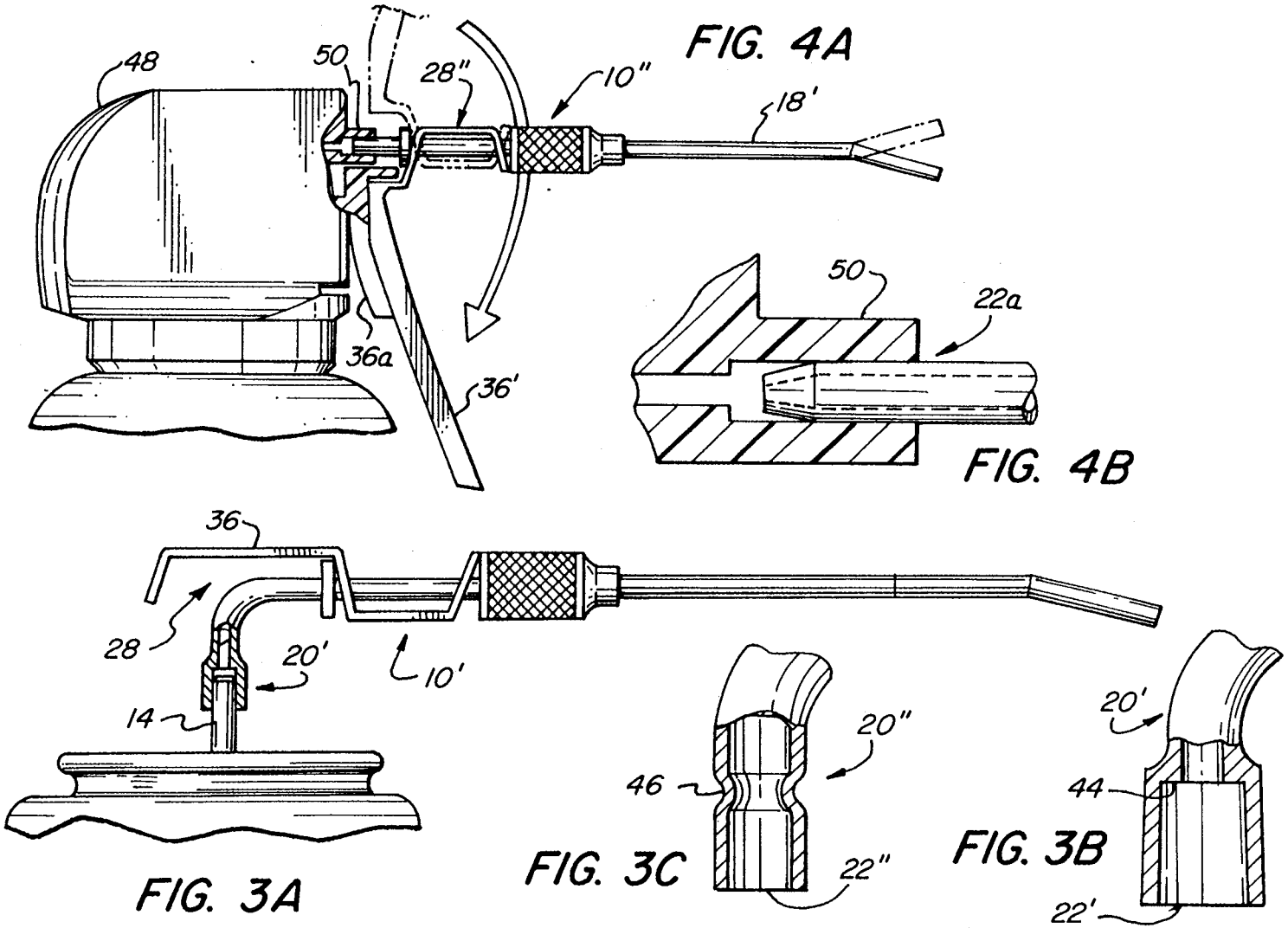
FIG. 3A is an elevational view of a spray nozzle according to still another embodiment of the invention mounted on a conventional aerosol dispenser stem valve.
FIGS. 3B and 3C are views, enlarged with respect to FIG. 3A, of alternative configurations of an inlet region of an extension tube of the nozzle of FIG. 3A.
FIG. 4A is an elevational view of a nozzle according to an alternative embodiment of the invention mounted on a conventional trigger-type aerosol dispenser valve.
FIG. 4B is a view, enlarged with respect to FIG. 4A, of the swaged inlet region of the extension tube secured in the spout of the trigger valve of FIG. 4A.

On the other hand, if the aerosol can lacks a dispersal fixture or, for example, if the dispersal fixture has been removed from the dispersal valve, the extension tube inlet may be dimensioned and configured to directly engage the dispersal valve. When the dispersal valve is a stem valve, the trigger portion of the actuation member preferably provides a convenient actuation surface for the user and is dimensioned and configured so that by pressing upon the trigger portion of the actuation member, the user can actuate the stem valve and disperse the contents of the can through the stem valve and the extension tube. Typically, the trigger portion is positioned opposite from the can relative to the valve outlet, as shown in FIG. 3A, so that the user can grasp the can and use a finger to press on the trigger portion of the actuation member to actuate the stem valve.

In the prior art, as represented by U.S. Pat. No. 4,819,837, an electrically conductive trigger portion, i.e., the metal button is physically mounted to the extension tube by a non-electrically conductive tube-engaging member or housing, making it necessary to provide an additional, non-structural electrical bridge between the button and the tube, provided by a wire or a resistor. In producing the present invention, the Applicant has eliminated the non-electrically conductive housing by providing an actuation member having a tube-engaging portion in which the electrically conductive material serves to mount the trigger portion on the extension tube. Thus, the Applicant has eliminated any need for a non-structural electrical bridge and has produced a nozzle that is therefore simpler in construction and more reliable in operation than the device shown in U.S. Pat. No. 4,819,837. Accordingly, as used in the claims in relation to the tube-engaging portion of the actuation member, the term "essentially electrically conductive", means that the tube-engaging portion provides the structural connection of the actuation member onto the extension tube and provides an electrical connection between the extension tube and the trigger portion of the actuation member by virtue of the structural connection, without the need for a non-structural electrical bridge.

Static electricity that develops in the extension tube by the flow of the contents of the aerosol can through the extension tube passes to the actuation member, and can be grounded onto the user due to the user's contact with the actuation member. Therefore, when used in conjunction with a user-grounding device such as the wrist strap described above, the invention provides a shunting circuit through which static electricity is discharged without flowing onto the workpiece being sprayed or handled. The result is that the aerosol dispenser is electrostatically safe to use on a sensitive workpiece.

Figures 1A, 1B, 1C, 1D, 1E, 2:
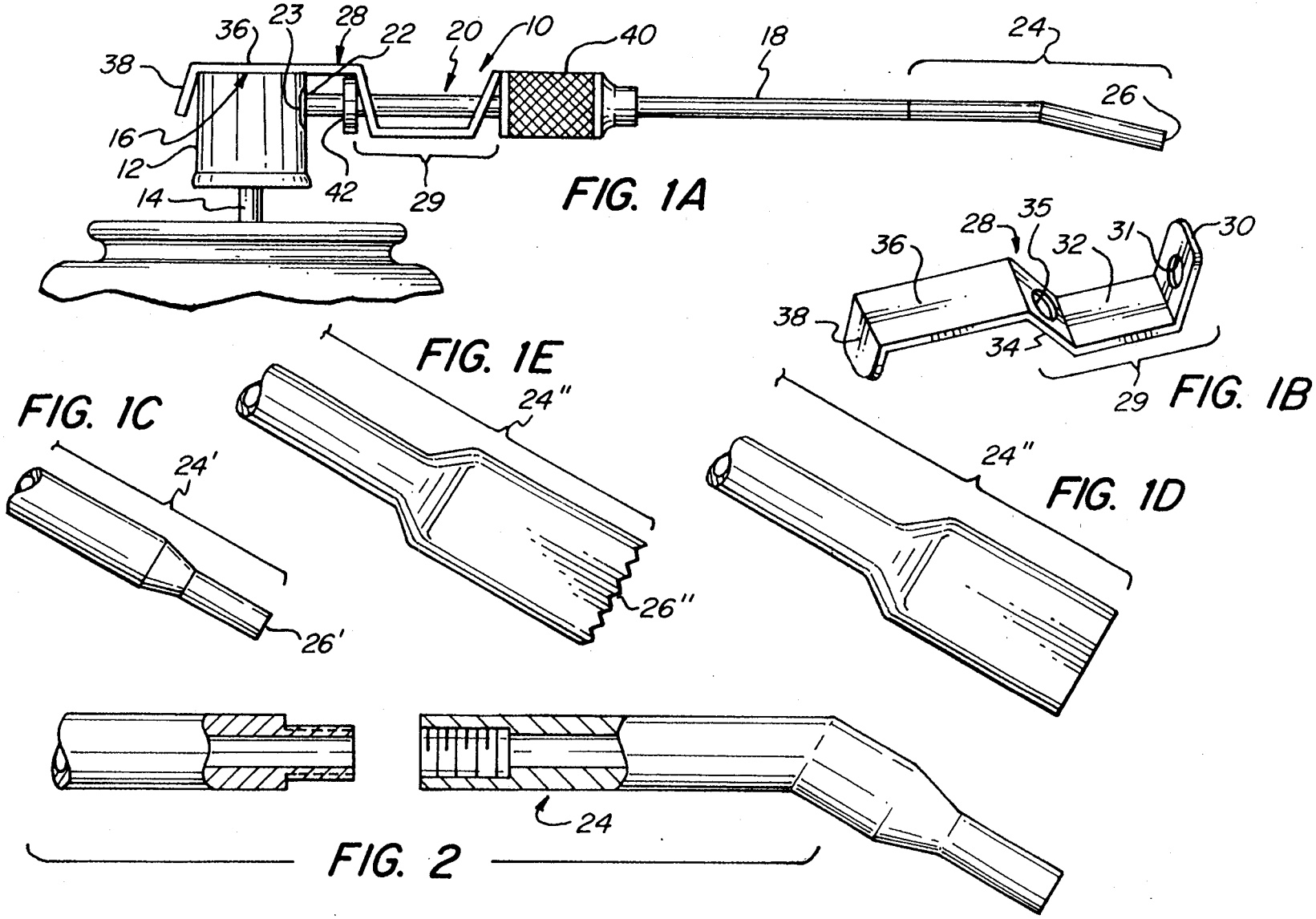
FIG. 1A is an elevational view of a spray nozzle in accordance with one embodiment of the present invention mounted on a conventional button-type aerosol dispenser valve.
FIG. 1B is a perspective view of the actuation member of the spray nozzle of FIG. 1A.
FIGS. 1C, 1D and 1E show alternative configurations of the discharge region and outlet of the extension tube of a nozzle according to the present invention.
FIG. 2 is a partially cross-sectional view of an extension tube having a detachable discharge region in accordance with the present invention.

One specific embodiment of the invention is shown in FIG. 1A, where nozzle 10 is shown mounted on a conventional aerosol spray button 12. Spray button 12 is part of a conventional dispenser valve comprising a stem valve 14 which, when pressed into the can, allows the pressurized contents of the can to flow therethrough. Spray button 12 includes an outlet 23 from which the contents of the can are expelled, when in conventional use, the user presses upon actuation surface 16 of button 12.

Nozzle 10 comprises an extension tube 18 which is made from an electrically conductive material such as a metal, e.g., stainless steel or a conductive, i.e., static dissipative, polymeric material. Inlet region 20 terminates at tube inlet 22, which is disposed in fluid-flow communication with the outlet 23 of spray button 12. At its other end, extension tube 18 has a discharge region 24 that terminates in a tube outlet 26. Between inlet region 20 and discharge region 24 is a central conduit portion (unnumbered). The inlet region 20 and the central conduit region constitute the main portion of the extension tube.

Nozzle 10 further comprises an actuation member 28, (FIG. 1B) which may be made from the same materials as extension tube 18, e.g., actuation member 28 may comprise an angled piece of stainless steel. The width of actuation member 28 in the illustrated embodiment corresponds approximately to the diameter of the conventional spray button 12. As seen in FIG. 1B, actuation member 28 comprises a tube-engaging portion 29 comprising a first anchor portion 30 that has a first aperture 31. Adjacent to first anchor portion 30 is a bridge portion 32 that is followed by a second anchor portion 34, which has a second aperture 35. As seen in FIG. 1A, the inlet region 20 of extension tube 18 passes through apertures 31 and 35, and actuation member 28 is thus mounted on extension tube 18.

The tube engagement portion 29 is dimensioned and configured to act as a spring clamp that firmly but slidably engages the extension tube therein. That is, first anchor portion 30 and the first aperture 31 therein, bridge portion 32, and second anchor portion 34 and the second aperture 35 therein are all dimensioned and configured so that when extension tube 18 extends therethrough, actuation member 28 is tensioned and slidably but securely grips extension tube 18. For example, actuation member 28 is configured so that the inlet region 20 of extension tube 18 may be inserted into first aperture 31 of first anchor portion 30 without hinderance, but in order to then insert the inlet region 20 through second aperture 35 in second anchor portion 34, it becomes necessary to flex first anchor portion 30 and/or bridge portion 32. After extension tube 18 has been inserted through both apertures, the flexure of actuation member 28 will cause first anchor portion 30 and second anchor portion 34 to "bite" or clamp onto the extension tube 18 and thus securely retain extension tube 18 therein. Nevertheless, it would still be possible to slide extension tube 18 through the apertures 31, 35 if sufficient force is applied to extension tube 18 and/or bridge portion 32 is flexed to relieve the force with which it grips extension tube 18.

A stop member 40 is fixedly attached to extension tube 18 to limit the extent to which extension tube 18 can be inserted into the first aperture. Stop member 40 may be an integral part of extension tube 18 or may be a distinct structure attached thereto by any suitable means such as welding, use of a mechanical fastener, glue, etc. Preferably, stop member 40 is dimensioned and configured to also provide a convenient finger grip by which the user may easily manipulate the nozzle 10 before mounting the nozzle 10 on the spray can. The cylindrical, knurled construction of stop member 40 illustrated in FIG. 1A provides this facility in the illustrated embodiment. An optional bushing 42 is placed on the inlet portion of extension tube 18 after extension tube 18 is inserted through the aperture 35 in second anchor portion 34. Preferably, bushing 42 is positioned to help inhibit the withdrawal of extension tube 18 from the second anchor portion 34 of actuation member 28.

Actuation member 28 further comprises a trigger portion 36. The actuation member 28 is dimensioned and configured so that trigger portion 36 can be disposed in engagement with actuation surface 16 of spray button 12. Thus, when nozzle 10 is properly positioned on spray button 12, the user can depress spray button 12 by pressing upon trigger portion 36 of the actuation member 28. In the embodiment of FIG. 1A, actuation member 28 further comprises a lip 38 which serves to secure nozzle 10 on spray button 12. Thus, actuation member 28 is dimensioned and configured to secure nozzle 10 on the dispenser can valve.

The contact between extension tube 18 and actuation member 28 established by the first and second anchor portions 30 and 34 of tube-enaging portion 29 is sufficient to establish a connection between them that allows static electricity to flow from one to the other, i.e., to establish electrical contact between them. Thus, should a static charge develop in extension tube 18, it may travel through actuation member 28 and thus be shunted onto a user who touches the nozzle, e.g., at trigger portion 36. By providing the user with a grounding apparatus such as a conventional grounding wrist strap described above, any electrostatic charge developed by the dispersal of aerosol product through extension tube 18 is discharged through the user's body, and is thus diverted away from the workpiece.

In the embodiment of FIG. 1A, the diameter of extension tube 18 is substantially uniform from tube inlet 22 to tube outlet 26. However, in various embodiments of the invention, the discharge region 24 may be swaged or otherwise formed to provide various different configurations. For example, as shown in FIG. 1C, the discharge region 24' may be tapered or constricted so that the tube outlet 26' on discharge region 24' has a diameter that is constricted with respect to the diameter of the main portion of the extension tube. The constricted configuration of tube outlet 26' is believed to be advantageous for use with coolants because it causes a back pressure in the extension tube that tends to keep the coolant more compressed than it would be if the tube outlet were not constricted. As a result, the coolant expands more precipitously upon being expelled from extension tube 18 than it would otherwise be. In some instances, the coolant may be liquified under pressure in the container and the constricted tube outlet can maintain sufficent pressure in the extension tube to keep the coolant in liquid form until it is expelled from the tube, when otherwise it would expand into gaseous form in the tube. By postponing the phase change of the coolant until it is expelled from the extension tube, its cooling effect on a workpiece is enhanced.

On the other hand, the constricted configuration of the tube outlet may provide a second advantage wholly separate from maintaining pressure in the tube. Specifically, and without wishing to be bound by any particular theory, the constricted outlet defines a small radius of curvature relative to the main portion of the extension tube and therefore cannot carry as high a concentration of static electricity as the main portion of the extension tube. Accordingly, the constricted tube outlet has been observed to discharge static electricity by causing corona ionization of the surrounding air, which further reduces *Recommended Practice on Static Electricity*, by the the risk of damage to the workpiece. This corona discharge phenomenon is discussed in further detail in National Fire Prevention Association, Inc., 1993 Ed., Sections 3-3.4.1 through 3-3.4.2.5, which are hereby incorporated herein by reference, as background information.

Alternatively, discharge region 24'' may be flattened into a duckbill configuration as shown in FIG. 1D and may be serrated at the tube outlet 26'', as illustrated in FIG. 1E. By making the discharge region 24 separable from the main portion of the extension tube, e.g., by giving the respective portions complementary male and female connection regions as shown in FIG. 2, a variety of variously configured discharge regions may be used interchangeably with the same tube main portion. Thus, for example, a flattened discharge region may be attached to the extension tube to disperse soldering flux, and then a discharge region having constricted tube outlet may be attached to the extension tube for dispersing post-soldering coolant. Optionally, the respective male and female coupling regions may have complementary threads so that the various discharge regions may be screwed onto the main portion of the extension tube. Alternatively, a bayonet-type or other connection type may be employed to join the discharge region to the main portion of the extension tube, or the discharge region may be integral with the rest of the extension tube.

In an alternative embodiment shown in FIG. 3A, nozzle 10' may comprise an inlet region 20' that is dimensioned and configured to directly engage stem valve 14. In such an embodiment, actuation member 28 replaces rather than supplements a spray button or other conventional dispersal fixture, which may be removed from stem valve 14 prior to mounting nozzle 10' thereon. Inlet region 20' is shown in greater detail in FIG. 3B where it is seen that tube inlet 22' is dimensioned and configured to receive stem valve 14 (not shown) therein and to provide a shoulder 44, which bears upon the end of stem valve 14, i.e., upon the actuation surface of the valve, when the user depresses trigger portion 36. In an alternative configuration (FIG. 3C), inlet region 20'' may comprise a crimp region 46 which is dimensioned and configured to establish a friction fit over the end of stem valve 14. A nozzle comprising inlet region 20'' is mounted on a stem valve by inserting the stem valve into tube inlet 22'' until crimp 46 is reached, and then depressing trigger portion 36 with pressure sufficient to force crimp 46 over the end of stem valve 14. Thereafter, the user may release the pressure from trigger portion 36, and the nozzle will be secured onto stem valve 14.

Yet another embodiment of a nozzle according to the present invention is shown in FIGS. 4A and 4B. Nozzle 10'' is dimensioned and configured to be securely mounted onto a trigger assembly 48 which provides a trigger actuated dispenser valve. In this embodiment, trigger portion 36' of actuation member 28'' is dimensioned and configured to extend over the trigger **36*a* of trigger assembly 48. Tube inlet 22*a* is inserted into spout 50 of trigger assembly 48 and is dimensioned and configured to provide a friction fit therein sufficient to securely retain nozzle 10'' onto trigger assembly 48. Preferably, the inlet region 20'' of extension tube 18'' is swaged as shown in FIG. 4B to facilitate the insertion of nozzle 10'' into trigger assembly 48. Preferably, to mount nozzle 10'' into trigger assembly 48, tube inlet 22*a* is inserted into spout 50 with trigger portion 36'' pointed upward as suggested in dotted outline in FIG. 4A. When inlet 22*a* is inserted to a satisfactory depth, the user rotates nozzle 10'' about the longitudinal axis of extension tube 18' so that trigger portion 36' turns 180° and, is disposed over the trigger of trigger assembly 48**, as suggested by the unnumbered rotation arrows.

The present invention thus provides a nozzle that is easily mounted on a variety of conventional aerosol discharge valves. The nozzle provides a tube through which the aerosol product flows and an actuation member which the user depresses in order to discharge the product. The nozzle provides an electrical connection between the extension tube and the actuator member so that any static electricity developed in the tube due to the flow of product therethrough is shunted from the tube to the user, thus suppressing static discharge to the workpiece. Preferably, the user's body is grounded, e.g., by the use of a conventional grounding wrist strap. There is no need for an additional grounding apparatus to electrically ground the spray valve to the workpiece or to a common ground.

Although the embodiments of the nozzle according to the present invention illustrated in the Figures and described above are structurally distinct from the conventional aerosol spray dispenser with which it is used, this should not be viewed as a limitation on the invention. For example, it would be within the purview of the invention to provide, for example, a combined dispersal fixture-and-nozzle that is manufactured as a monolithic unit. Thus, an aerosol spray button may be modified by forming an extension tube as an integral part of the button, and by providing an actuation surface on the button that is in electrical contact with the extension tube. For example, the button and tube may all be made of electrically conductive material. Further, the trigger portion of the actuation member need not be disposed over the actuation surface of the dispersal fixture. For example, the trigger portion may comprise a grounding pad disposed on the surface of the can, so that when the user grasps the can to depress the dispersal fixture, the user's palm, thumb or fingers contact the grounding pad. Accordingly, while the invention has been described in detail with respect to specific preferred embodiments thereof, it is to be understood that upon a reading of the foregoing description, variations to the specific embodiments disclosed will occur to those skilled in the art and it is intended to include such variations within the scope of the appended claims.

What is claimed is:

1. A user-grounded spray nozzle for an aerosol product/spray can having a dispersal valve having an outlet, the nozzle comprising:

an electrically conductive extension tube having (a) an inlet region comprising a tube inlet for receiving the gaseous or aerosol discharge from the outlet of the dispersal valve or of a dispersal fixture on the dispersal valve, the dispersal fixture having an actuation-surface and an outlet, and (b) a discharge region comprising a tube outlet for expelling the contents of the can; and an electrically conductive actuation member comprising an essentially electrically conductive tube engagement portion and a trigger portion, the tube engagement portion securing the actuation member to the extension tube and thereby providing an electrical connection between the extension tube and the trigger portion, the trigger portion being dimensioned and configured so that when the user manually engages the trigger portion and releases the aerosol product through the extension tube, the actuation member provides a static electricity discharge connection between the extension tube and the trigger portion of the actuation member so that static electricity can be shunted from the extension tube to a user's body when the user depresses the actuation member.

2. The spray nozzle of claim 1 wherein the tube inlet is dimensioned and configured to engage the outlet of a stem valve.

3. The spray nozzle of claim 1 wherein the tube inlet is dimensioned and configured to engage the outlet of a dispersal fixture, and wherein the trigger portion of the actuation member is dimensioned and configured to engage the actuation surface of the dispersal fixture when the tube inlet engages the outlet of the dispersal fixture.

4. The spray nozzle of claim 3 wherein the inlet region of the extension tube is swaged to provide a friction fit in the outlet of the dispersal fixture to secure the tube inlet therein.

5. The spray nozzle of claim 2 or claim 3 wherein the tube engagement portion comprises a spring clamp firmly but slidably engaging the extension tube.

6. The spray nozzle of claim 5 wherein the spring clamp comprises a first anchor portion, a bridge portion adjacent to the first anchor portion and a second anchor portion adjacent to the bridge portion, the first anchor portion comprising a first tube aperture dimensioned and configured to receive the extension tube therein, the second anchor portion comprising a second tube aperture dimensioned and configured to receive the extension tube therein, and the extension tube being disposed within both the first and second tube apertures.

7. The spray nozzle of claim 2 or claim 3 wherein the spray can includes a dispersal fixture on the dispersal valve and wherein the trigger portion is dimensioned and configured to secure the nozzle to the dispersal fixture.

8. The spray nozzle of claim 2 or claim 3 wherein the actuation member is slidably mounted on the extension tube and wherein the spray nozzle further comprises at least one stop member mounted on the extension tube to limit sliding travel of the actuation member on the extension tube.

9. The spray nozzle of claim 2 or claim 3 wherein the discharge region of the extension tube has a tapered configuration.

10. The spray nozzle of claim 2 or claim 3 wherein the discharge region of the extension tube has a flared configuration.

11. The spray nozzle of claim 2 or claim 3 wherein the tube outlet has a sawtooth configuration.

12. The spray nozzle of claim 2 or claim 3 wherein the extension tube comprises separable first and second parts, the first part comprising the inlet region and the second part comprising the discharge region.

13. An aerosol spray dispenser comprising:

a closed cannister for storing a pressurized fluid product;

a stem valve for releasing the pressurized fluid from the can by actuating the stem valve;

a dispersal fixture on the stem valve having an outlet and an actuation surface to provide a convenient method for actuating the stem valve to disperse the pressurized fluid;

a nozzle mounted on the dispersal fixture, the nozzle comprising:

(i) an electrically conductive extension tube having (a) an inlet region comprising a tube inlet for receiving the gaseous or aerosol discharge from the outlet of the dispersal fixture, and (b) a discharge region comprising a tube outlet for expelling the contents of the can; and (ii) an electrically conductive actuation member comprising a tube engagement portion and a trigger portion, the tube engagement portion securing the actuation member to the extension tube and providing electrical conductivity between the extension tube and the trigger portion, the trigger portion being dimensioned and configured to engage the actuation surface of the dispersal fixture of the spray can while the tube inlet is disposed in fluid-flow communication with the dispersal fixture outlet, so that the user can actuate the stem valve and release the aerosol product through the extension tube by depressing the actuation member, the actuation member providing a static electricity discharge connection between the extension tube and the trigger portion so that static electricity can be shunted from the extension tube to a user's body when the user manually depresses the actuation member.

14. The dispenser of claim 13 wherein the tube engagement portion of the actuation member comprises a spring clamp firmly but slidably engaging the extension tube.

* * * * *

UNITED STATES PATENT AND TRADEMARK OFFICE

CERTIFICATE OF CORRECTION

PATENT NO. : 5,423,458

DATED : June 13, 1995

INVENTOR(S) : Jay S. Tourigny

It is certified that error appears in the above-indentified patent and that said Letters Patent is hereby corrected as shown below:

In column 4, line 14, replace "enngage" with --engage--.

In column 6, line 29, replace "tube-enaging" with --tube-engaging--.

In column 7, lines 10, 11, 12 and 13, replace "further reduces Recommended Practice on Static Electricity, by the risk of damage to the workpiece. This corona discharge phenomenon is discussed in further detail in" with --further reduces the risk of damage to the workpiece. This corona discharge phenomenon is discussed in further detail in Recommended Practice on Static Electricity, by the --.

In column 8, line 61 (Claim 1), replace "duct/spray" with --duct spray--.

In column 8, line 68 (Claim 1), replace "tuation-surface" with --tuation surface--.

Signed and Sealed this

Twenty-fourth Day of October, 1995

Bruce Lehman

*Attest:*

BRUCE LEHMAN

*Attesting Officer*

*Commissioner of Patents and Trademarks*